United States Patent [19]

Ruhnke et al.

[11] Patent Number: 4,969,504

[45] Date of Patent: Nov. 13, 1990

[54] EVAPORABLE FOAM PATTERN FOR USE IN CASTING AN EXHAUST MANIFOLD

[75] Inventors: Jeffrey P. Ruhnke, Fond du Lac; Ricky H. Lulloff, Neenah; Gordon L. Stiller, Omro, all of Wis.

[73] Assignee: Brunswick Corporation, Skokie, Ill.

[21] Appl. No.: 383,919

[22] Filed: Jul. 21, 1989

[51] Int. Cl.[5] ..... B22D 19/00; B22C 7/02

[52] U.S. Cl. ..... 164/235; 164/245; 164/246

[58] Field of Search ..... 164/235, 246, 249, 34, 164/35, 36, 45

[56] References Cited

U.S. PATENT DOCUMENTS

| | | | |
|---|---|---|---|
| 3,729,937 | 5/1973 | Haddad | 164/98 |
| 4,243,093 | 1/1981 | Neiman | 164/98 |
| 4,421,153 | 12/1983 | Wilkinson et al. | 164/34 |
| 4,632,109 | 12/1986 | Osborn et al. | 164/45 |
| 4,640,333 | 2/1987 | Martin et al. | 164/246 |
| 4,657,063 | 4/1987 | Morris | 164/45 |
| 4,777,997 | 10/1988 | Corbett | 164/246 |
| 4,802,447 | 1/1989 | Corbett | 164/45 |
| 4,883,110 | 10/1989 | Morgan et al. | 164/249 |

FOREIGN PATENT DOCUMENTS

| | | | |
|---|---|---|---|
| 2569225 | 2/1986 | France | 164/34 |
| 52-29522 | 3/1977 | Japan | 164/98 |
| 62-148055 | 7/1987 | Japan | 164/246 |
| 62-282763 | 12/1987 | Japan | 164/34 |

OTHER PUBLICATIONS

"Evaporative Foam Casting Technology II Program", Nov. 1986.

*Primary Examiner*—Richard K. Seidel
*Assistant Examiner*—Rex E. Pelto
*Attorney, Agent, or Firm*—Andrus, Sceales, Starke & Sawall

[57] ABSTRACT

An evaporable foam pattern for casting a metal water-cooled exhaust manifold for an internal combustion engine. The assembled pattern is formed of an evaporable foam polymeric material, such as polystyrene, and includes an inner exhaust conduit composed of a generally upright body portion and a generally curved elbow portion. The body portion is provided with a plurality of inlet ports connected to the exhaust passages of a bank of cylinders, while the elbow portion defines a downwardly facing outlet. The pattern also includes an outer water jacket which is spaced from the exhaust conduit to provide a water passage therebetween. Both the exhaust conduit and the outer jacket are composed of two longitudinally split halves or sections having abutting edges, and the abutting edges are joined together by an adhesive. Spacing ribs interconnect the inner surface of the jacket and the outer surface of the exhaust conduit to space the sections apart. The inlet ports of the exhaust conduit section are located only in one of the exhaust conduit pattern sections.

20 Claims, 3 Drawing Sheets

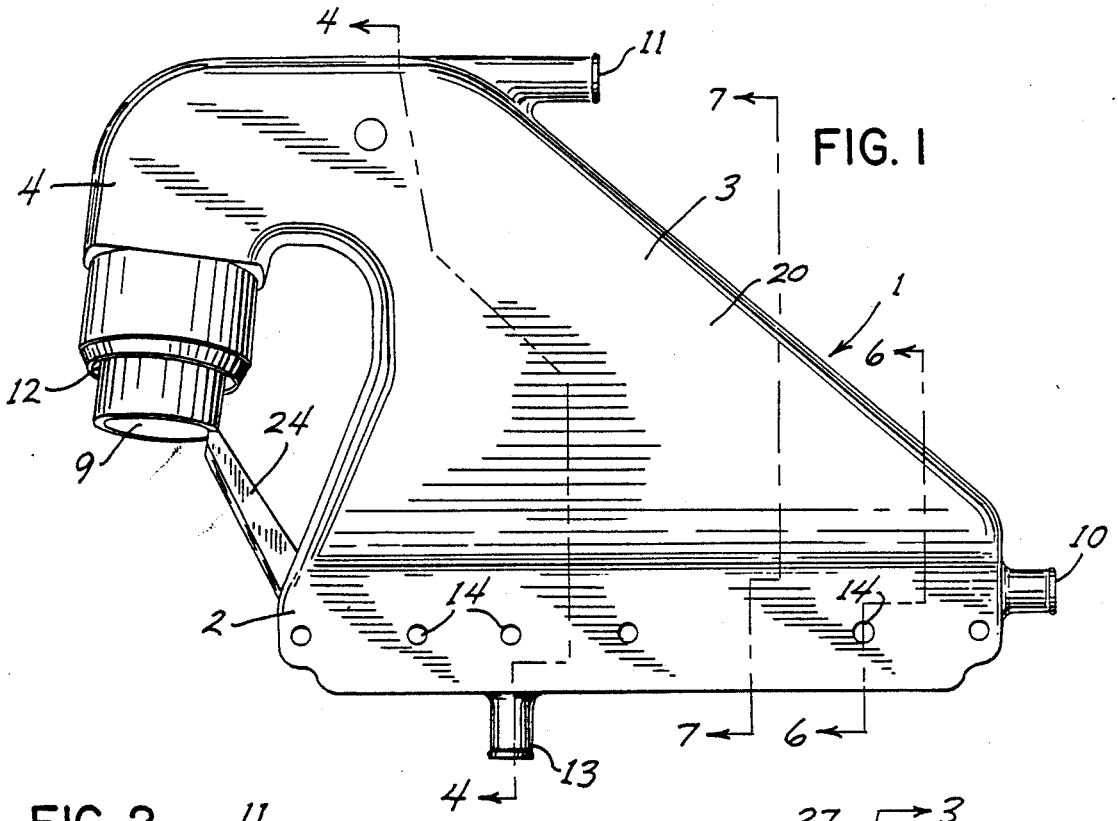
FIG. 1
FIG. 2
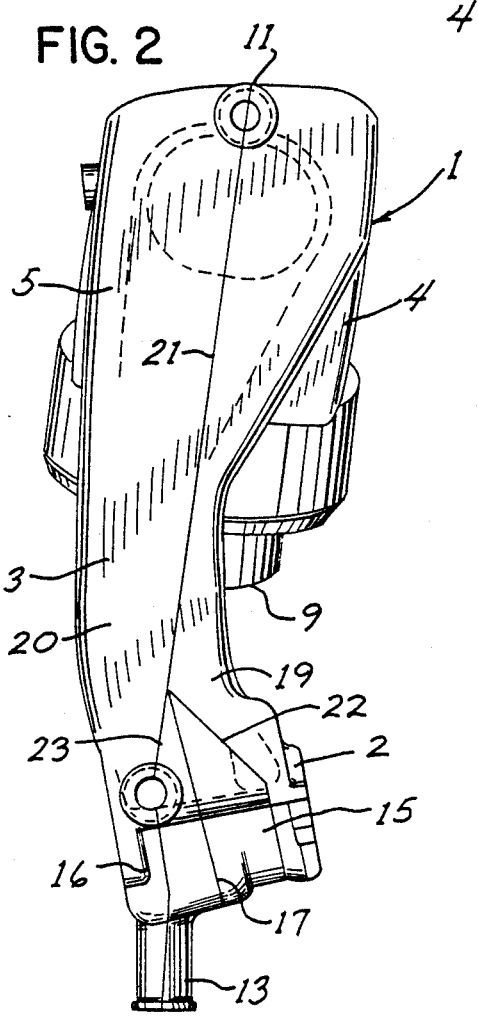
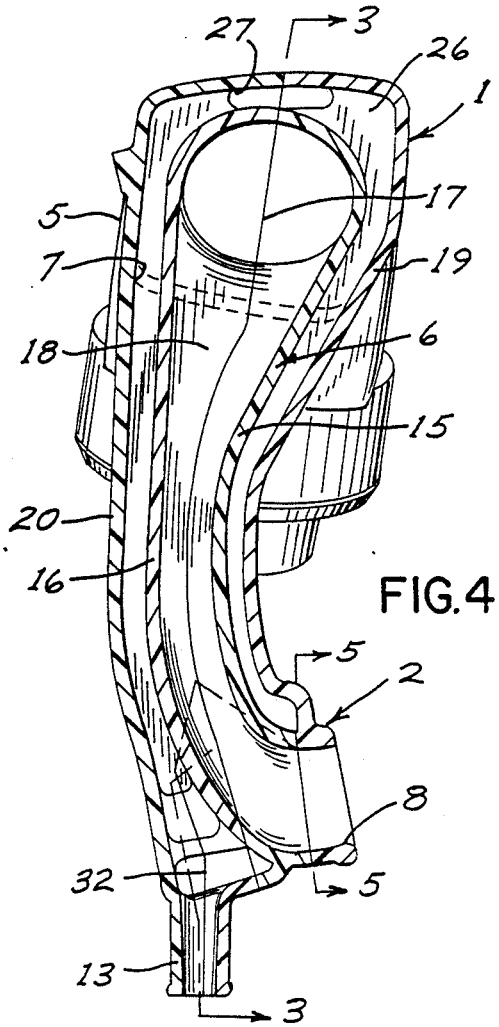
FIG. 4

EVAPORABLE FOAM PATTERN FOR USE IN CASTING AN EXHAUST MANIFOLD

BACKGROUND OF THE INVENTION

Internal combustion engine blocks and engine components are frequently produced by an evaporable foam casting process. In the typical evaporable foam casting process, a pattern, identical in shape to the cast part to be produced, is formed from an evaporable foam material, such as expanded polystyrene. The pattern is placed in a mold or flask, and the mold is filled with a flowable material, such as sand, which also fills the cavities of the pattern. A molten metal is introduced to the pattern via a sprue and the heat of the molten metal will vaporize the foam material with the vapor passing into the interstices of the sand, while the molten metal will fill the void created by vaporization of the foam material. The result is a cast metal part having a configuration identical to that of the foam pattern.

Evaporable foam casting processes have distinct advantages. In certain instances a number of components can be combined in the foam pattern to provide an integral cast part, as opposed to sand casting processes where the components are individually cast and then connected together by gaskets and bolts.

The use of evaporable foam patterns also increases the flexibility of the casting process and enables the pattern to be designed so as to reduce the weight of metal to be used and provide more uniform wall thicknesses to increase the rate of heat transfer.

A V-6 stern drive marine engine includes a pair of exhaust manifolds which are mounted on either side of the engine. The typical exhaust manifold consists of a generally flat upright body portion which is merged into a curved elbow portion. The manifold is composed of an inner exhaust conduit which is surrounded by an outer water jacket to define a water passage therebetween. The exhaust conduit is formed with a plurality of inlet ports which register with exhaust ports in a bank of cylinders of the engine, and the exhaust conduit terminates in a downwardly facing outlet located in the elbow portion and the outlet is positioned concentrically within the water jacket.

In the past, exhaust manifolds have been formed of two separate sections, namely the body portion and the elbow portion, which are joined together by bolts. The bolted construction requires that the mating surfaces having an increased section thickness and it is necessary to drill and tap holes in the mating surfaces to receive the bolts. In addition, gaskets are required at the mating surfaces.

The bolted connection not only increases the overall weight of the exhaust manifold due to the requirement for increased section thickness, but substantially increases the overall cost of the manifold due to the machining, drilling and tapping requirements, as well as the necessity of using gaskets and bolts.

In other instances, cast iron exhaust manifolds have been produced as a single piece by sand casting techniques, utilizing a two-piece water jacket core and an exhaust passage core. However, sand casting of the manifold requires external and internal core support systems and necessitates the use of relatively thick cores to add strength to the cores during assembly and during metal pouring. In addition, sand casting requires additional parts and operations to subsequently plug the core holes. Further, sand cast parts require thicker wall sections to enhance metal flow. Because of this, sand cast parts are physically larger castings which, when used in marine applications, infringe on usable space in the boat as well as decreasing the power to weight ratio of the boat. Moreover, sand cast parts require considerable machining which adds to the overall cost.

SUMMARY OF THE INVENTION

The invention is directed to an evaporable foam pattern for use in casting a metal water-cooled exhaust manifold for an internal combustion engine, such as a V-6 stern drive marine engine. The assembled pattern includes a generally flat upright body portion which is to be attached to the cylinder head and an outer curved elbow portion. The pattern includes an inner exhaust conduit having a plurality of inlet ports to be connected to the exhaust ports of a bank of cylinders of an engine, and having a downwardly facing outlet in the elbow portion. In addition, the pattern includes an outer jacket which is spaced outwardly from the inner exhaust conduit to provide a water passage therebetween.

Both the exhaust conduit and the water jacket are composed of a pair of longitudinal sections having abutting edges and the abutting edges are joined by a glue or adhesive, of the type commonly used in evaporable foam casting processes. The adhesive will vaporize under the heat of the molten metal during casting, so that there will be no residual adhesive in the cast metal part. Further, the adhesive should impart but a minimal amount of carbon to the cast metal on vaporization.

More specifically, the pattern is composed of a pair of mating inner exhaust sections, which in combination, define the exhaust passage or conduit, and a pair of mating outer water jacket sections that are spaced laterally from the exhaust sections to provide a water cooling passage therebetween.

To space the outer jacket sections from the inner exhaust sections, a series of spacing ribs are formed on the inner surface of each jacket section and bear against the outer surface of the exhaust sections. A layer of adhesive or glue serves to bond the outer extremities of the ribs to the exhaust sections. One or more of the ribs extends substantially through the entire annular space between the outer jacket and the inner exhaust conduit and is provided with a discontinuity at the upper end of the rib which aids in sand fill during the molding process, and in the cast metal manifold, provides a bleed hole to control the flow of water and air through the water passage in the manifold.

As a feature of the invention, the inlet ports in the exhaust conduit are formed in only one of the exhaust sections, and these, in turn, are mated and joined with inlet ports in one of the outer water jacket sections, so that the inlet ports, in the cast metal manifold, will be precisely located with respect to each other. In addition, the proper relationship between the exhaust inlet ports and the water outlet in the elbow portion is maintained due to the fact that the inlet ports and the outlet are in the same pattern section.

With the use of the pattern of the invention both the body portion and the curved elbow portion of the manifold can be cast as a single integral part. This eliminates the necessity of machining mating surfaces and tapping and drilling holes, as required in a two-piece manifold construction to join the neck portion to the body portion. In addition, by casting the body and neck portions integrally, it is not necessary to increase the section thickness at the joint between the portions, as has been required in the past.

The use of the pattern of the invention also enables baffling to be incorporated in the water cooling passage of the manifold which provides a more effective distribution of the water to all areas of the water passage to promote more effective cooling by eliminating hot-spots. The location, design and placement of all water passages in the pattern are chosen specifically to aid in the sand fill during the molding process and to enhance water circulation in the cast metal manifold.

As a further advantage, the base of the manifold, which is to be connected to the cylinder head, can be cast with recesses or holes to receive connecting bolts, as opposed to the prior practice of forming the base with an increased section thickness and then drilling bolt holes in the base. The invention thus reduces the amount of cast metal to be used, and similarly eliminates the operation of drilling bolt holes in the base of the manifold.

Using the evaporable foam pattern of the invention to cast the exhaust manifold has distinct advantages over sand casting the manifold in a single piece as practiced in the past. The evaporable foam pattern eliminates the complicated core systems as required in sand casting and avoids core shifting, thus resulting in a cast metal part having more precisely defined wall thicknesses. As a result the casting can be produced with thinner wall sections which provides a more compact, lighter weight metal casting.

The parting lines between the pattern sections are located such that the pattern can be readily assembled in high speed assembly lines and the pattern sections are designed so that the sand will readily fill all of the cavities in the pattern during the casting procedure.

In the conventional evaporable foam casting process, a ceramic wash is normally applied to all of the internal and external surfaces of the pattern prior to casting. The design of the pattern of the invention is such that the ceramic wash will readily contact all internal and external surfaces and will readily drain from the pattern after the pattern is removed from the wash tank.

Other objects and advantages will appear in the course of the following description.

DESCRIPTION OF THE DRAWINGS

The drawings illustrate the best mode presently contemplated of carrying out the invention.

In the drawings:

FIG. 1 is a side elevational view of the outer side of the exhaust manifold pattern of the invention;

FIG. 2 is an end view of the pattern;

FIG. 4 is a section taken along line 4—4 of FIG. 1;

DESCRIPTION OF THE ILLUSTRATED EMBODIMENT

Figure 3:
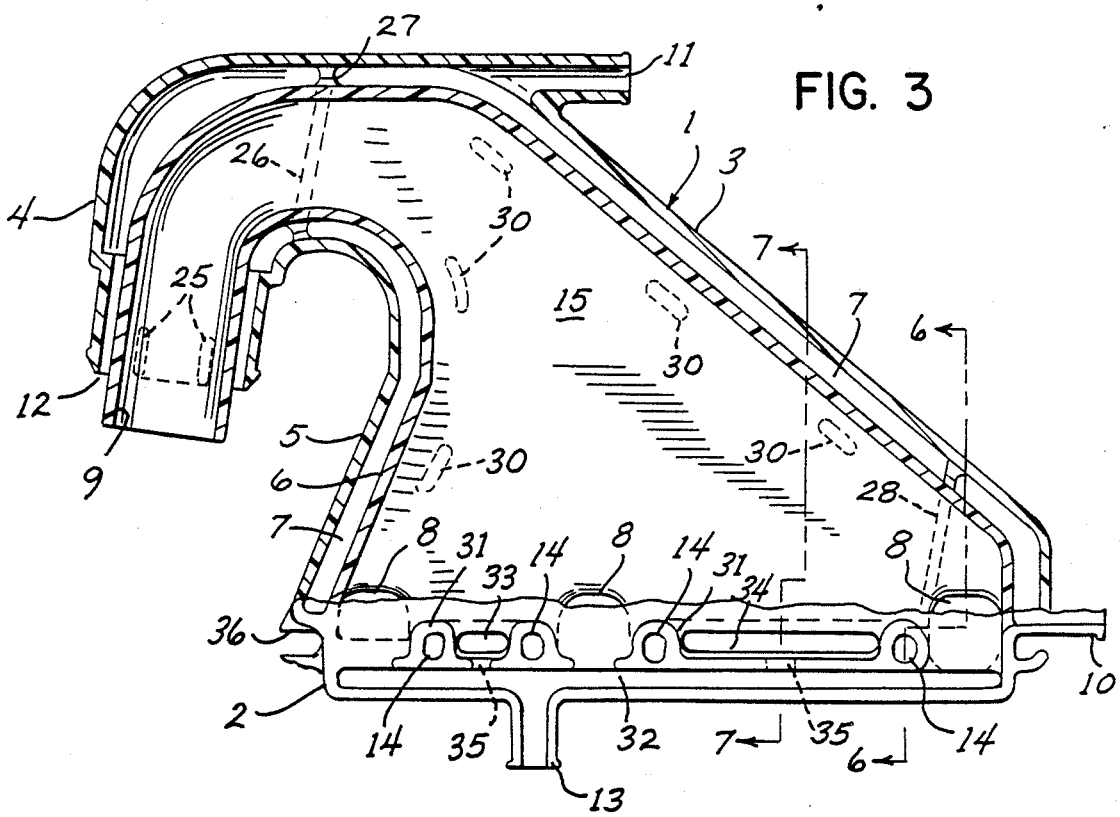
FIG. 3 is a side elevation of the inner surface of one of the exhaust sections of the pattern as assembled with a water jacket section and the lower portion of the other exhaust section.

The drawings illustrate a pattern to be used in casting a metal, water cooled, exhaust manifold for an internal combustion engine. The pattern has particular application for casting a manifold for a V-6 stern drive marine engine and in that application the pattern would be formed of an evaporable foam material, such as expanded polystyrene, polymethylmethacrylate, or other suitable material.

The pattern is identical in configuration to the cast metal manifold and, therefore, the description of the pattern will be made in reference to the metal casting.

As illustrated, the pattern is employed to cast an exhaust manifold for one bank of cylinders of a V-6 engine and in the completed engine, a pair of cast manifolds would be located on each side, each connected to a bank of three cylinders, of the engine.

The pattern 1 includes a base 2 which is adapted to be connected to the cylinder head and a generally flat upright body 3 extends upwardly from the base and terminates in a downwardly curved elbow portion 4.

The pattern is formed with an outer jacket 5, which is spaced outwardly from an inner exhaust conduit 6 to provide a water passage 7 therebetween. One end of exhaust conduit 6 is provided with a plurality of inlet ports which are mated and joined with inlet ports 8 in the outer jacket 5. The inlet ports 8, in the cast metal manifold, are adapted to be connected to the exhaust passages of a bank of cylinders of the engine. The opposite end of the exhaust conduit 6 defines an exhaust outlet 9, which projects from the elbow portion of outer jacket 5 and faces downwardly.

Cooling water is adapted to be introduced into the passage 7 through a pair of water inlets 10 and 11. Thermostatically controlled water is introduced through inlet 10, while dumping water is introduced into the passage 7 through the inlet 11. The water passage 7 terminates in an outlet 12, which is disposed concentrically around the exhaust outlet 9 in the neck portion 4 of the manifold.

Base portion 2 is also formed with a downwardly facing drain nipple 13, which communicates with the water passage 7. In the cast manifold the drain nipple 13 is normally closed off by a plug. Nipple 13 may also be used to introduce water into water passage 7 if inlet 10 is plugged.

The base 2 of the manifold is provided with a plurality of horizontal holes 14, which in the cast manifold receive bolts to connect the manifold to the cylinder head.

As seen in FIG. 4, exhaust conduit 6 is composed of a pair of longitudinally split exhaust pattern sections 15 and 16 which can be connected together along interface or parting line 17 by an adhesive of the type commonly used in evaporable foam casting procedures. Exhaust sections 15 and 16 in combination define exhaust passage 18.

Outer jacket 5 is also composed of a pair of longitudinally split jacket pattern sections 19 and 20 that are spaced outwardly from exhaust conduit 6 to provide the cooling water passage 7. The upper edges of jacket sections 19 and 20 are connected together along a parting line 21 by an adhesive, while the lower edges of sections 19 and 20 are connected by an adhesive to the exhaust sections 15 and 16 along parting lines 22 and 23, respectively, as shown in FIG. 9.

Figure 8:
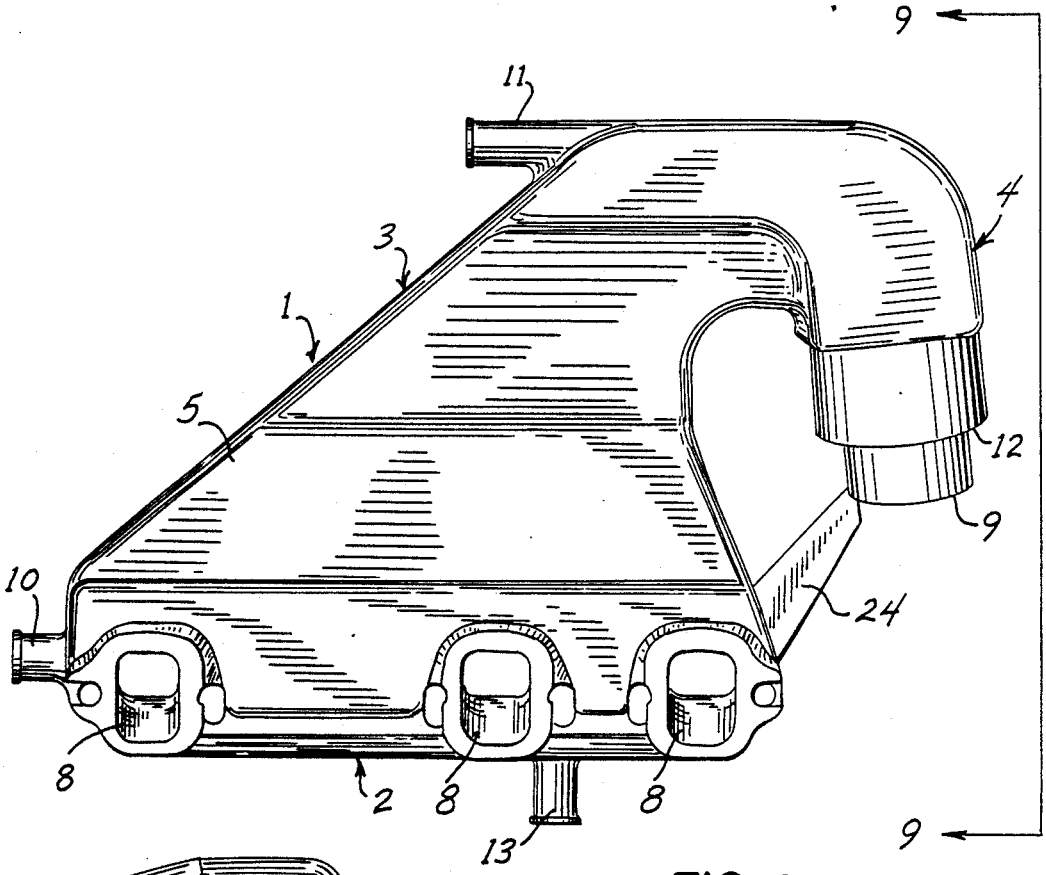
FIG. 8 is an elevational view of the inner side of the pattern.
Figure 9:
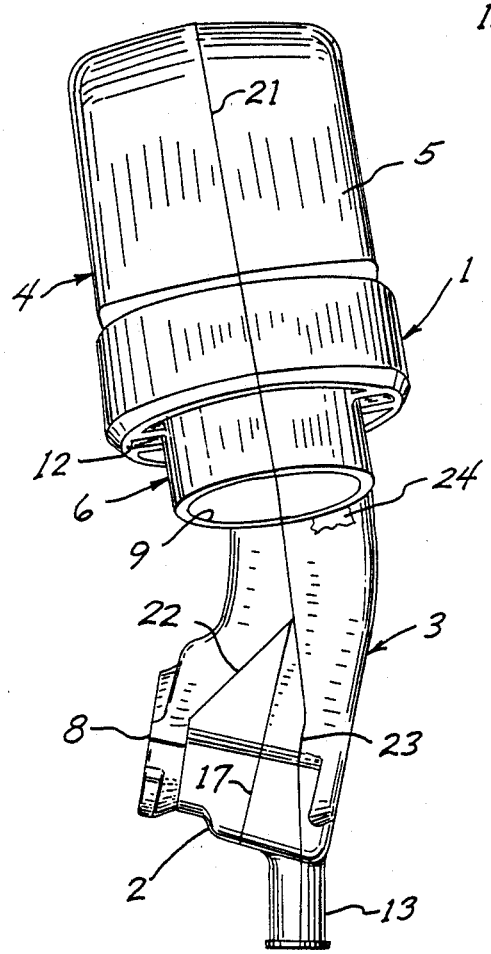
FIG. 9 is an end view of the pattern taken along line 9—9 of FIG. 8.

A stringer 24 connects the base portion of exhaust pattern section 16 with the outlet portion of that pattern section as illustrated in FIGS. 1, 8 and 9. Stringer 24, which is also formed of evaporable foam material, serves to prevent deformation or bending of the relatively flexible pattern, and during the molding operation the stringer is vaporized and serves as an additional flow path for the molten metal. Stringer 24 is located such that the flow of molten metal is enhanced. After casting, the metal stringer is removed from the cast manifold.

Jacket 5 and exhaust conduit 6 are maintained in spaced relation by a series of spacing ribs. More particularly, a series of ribs 25 extend inwardly from the outlet 12 of jacket 5 and are bonded by an adhesive to the exhaust outlet 9. In addition, as best shown in FIG. 4, a generally annular spacing rib 26 extends inwardly from jacket 5 at elbow portion 4 and is bonded to the outer surface of exhaust conduit 6. Rib 26 acts as a dam in the cast metal part and the upper end of the rib is provided with a hole or gap 27, and in the cast manifold, water and air can flow through the gap 27 to the water outlet 12.

Figure 6:
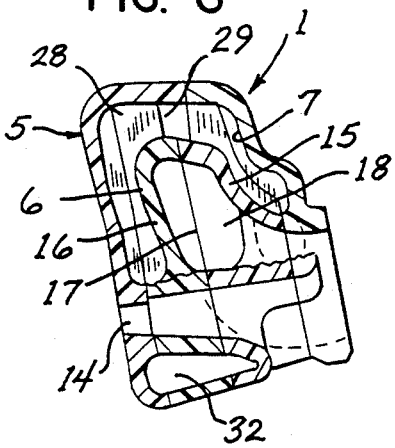
FIG. 6 is a section taken along line 6—6 of FIG. 3.
Figure 7:
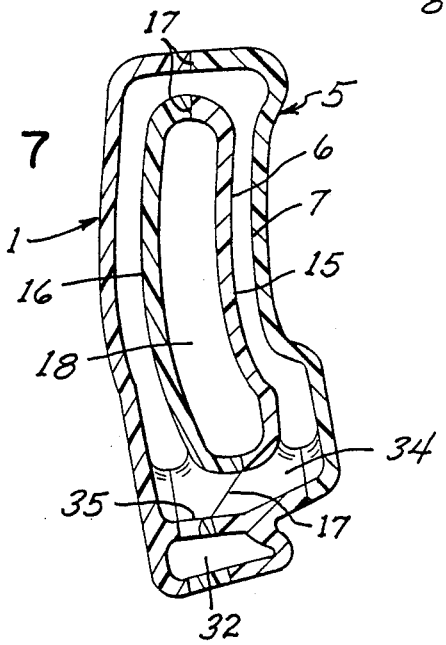
FIG. 7 is a section taken along line 7—7 of FIG. 3.

A similar spacing rib 28 is located adjacent the water inlet 10. Rib 28, as best shown in FIG. 6, substantially encloses the space between the outer jacket 5 and the inner exhaust conduit 6, except for a hole or gap 29 at the upper end of the rib. A majority of the water entering the cast manifold through inlet 10 will be directed downwardly to the lower portion of water passage 7, creating a current, while a second portion of the water will flow through the gap 29 along the upper surface of the exhaust conduit 6. Gap 29 also functions as an air bleed hole in the cast manifold. Gaps 27 and 29 also aid in filling the pattern with sand during the molding procedure.

The pattern also includes a group of short spacing ribs 30 that are located on the outer surface of exhaust pattern sections 15 and 16 and are adhesively bonded to the inner surfaces of jacket sections 19 and 20, respectively.

Cooling water inlet 10 communicates with the lower end of passage 7 and the inlet, as seen in FIG. 2, is split by the parting line 23. The inner surfaces of exhaust pattern sections 15 and 16 are each formed with mating bosses 31, as shown in FIG. 3, and a lower water passage 32 is formed in each section 15,16 below the boss 31, and the mating passages 32 extend beneath the exhaust conduit 6. Most of the cooling water entering inlet 10, in the cast manifold will be directed into the lower passages 32, by dam or rib 28, while a second portion will flow around the exhaust conduit 6 in passage 7. As previously noted, gap 29 allows air which may be trapped in the lower portion of the water jacket to escape upwardly.

Drain outlet 13 communicates with lower passage 32 and is split by the parting line 23, as seen in FIGS. 2 and 9.

In addition, exhaust pattern sections 15,16 are each provided with a pair of mating cross passages 33 and 34 which extend beneath exhaust conduit 6 and establish communication between opposite sides of passage 7 and provide additional cooling, in the cast manifold, for the heavy base 2. Ports 35 connect the cross passages 33 and 34 with lower passage 32.

The water passages 7, 32, 33 and 34, as well as ribs 28 and 29 are designed to provide adequate cooling for the exhaust conduit 6 in the cast metal manifold, and to facilitate sand filling of the internal cavities of the pattern in the molding procedure. Passages 35 also aids in filling the cavities of the pattern with sand in the molding operation, and in the cast metal manifold, function to improve the flow of cooling water to passage 7, as well as serving to drain water to the drain outlet 13.

The exhaust ports 8 are formed in section 19 and 15 and the mating and joining of all the sections (19,20,15 and 16) insures that the ports in the cast manifold will be precisely positioned relative to each other and accurately oriented with respect to the exhaust outlets in the cylinder head. Further, as the water jacket pattern sections 19 and 20 extend continuously from the inlet ports 8 in section 19, to the water jacket outlet 12, the proper orientation will be maintained between the inlet ports and outlet. Stringer 24 also aids in maintaining this orientation during the molding operation by preventing deflection or bending of elbow portion 4 relative to body portion 2.

Figure 5:
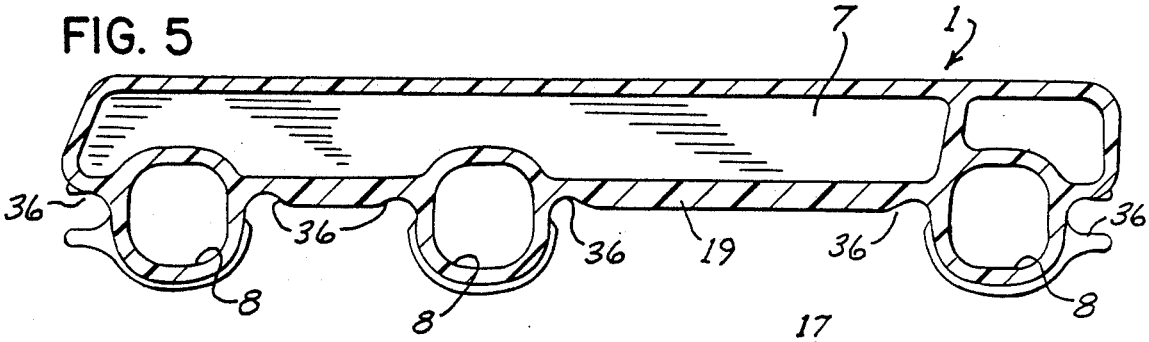
FIG. 5 is a section taken along line 5—5 of FIG. 4.

Bolt holes 14 extend through jacket section 20 and exhaust sections 16 and 15, and appear as recesses 36 in sections 19 and 15, as indicated in FIGS. 8 and 5, and receive bolts when the cast manifold is attached to the cylinder head.

The adhesive used to bond the pattern sections can be a conventional type commonly used in evaporable foam casting procedures. When exposed to the molten metal, the adhesive will vaporize along with the evaporable foam material, so that no residual adhesive will be present in the cast metal part. Preferably, the adhesive should be a type that will impart minimal carbon to the cast metal.

After assembly of the pattern 1, the pattern is normally washed with a ceramic wash material, as used in conventional evaporable foam casting processes and the design of the pattern is such that the ceramic wash will readily contact all the external and internal surfaces of the pattern and will readily drain from the pattern.

The pattern containing the dried ceramic wash coating is then placed in a mold or flask and the area surrounding the pattern, as well as the internal cavities within the pattern are filled with flowable material, such as sand. As previously noted, the design of the water passages facilitates filling of the internal cavities with sand.

During the casting procedure, a molten metal, such as steel or aluminum alloy, is fed via a sprue to the pattern and the heat of the molten metal will vaporize the pattern with the vapor being trapped within the interstices of the sand, while the molten metal will occupy the void created by vaporization of the foam material, with the result that a cast metal manifold is produced having a shape identical to the pattern 1.

As the entire manifold, including the body portion and the curved elbow portion, is cast as an integral part, a substantial reduction in weight and cost is achieved. In a method of casting the manifold, as used in the past, in which the body portion and elbow portions were cast separately, it was necessary to increase the section thickness of the joint between the elbow portion and body in order to provide sufficient stock for a gasketed and bolted joint. Through use of the pattern of the invention, it is not necessary to increase the section thickness, thereby resulting in a reduction in metal and a corresponding reduction in weight. Further, the machining, drilling and tapping operations, as well as the cost of the gaskets and bolts is eliminated.

The pattern of the invention also incorporates preformed bolt holes which eliminates the need for drilling the bolt holes in the base, as occurred in the past.

The invention also has distinct advantages over sand casting operations, as previously used. The use of the evaporable foam pattern eliminates complex core support systems as needed in sand casting and avoids core shifting, thus producing a metal casting having more precise wall thicknesses. As a result thinner wall sections are possible which produce a lighter weight, more compact casting.

By designing the mating surfaces of the pattern sections in the form of long sweeping curves, the adhesive will adhere to the surfaces, minimizing the amount of adhesive flowing down the surfaces and collecting at sharp corners.

Various modes of carrying out the invention are contemplated as being within the scope of the following claims particularly pointing out and distinctly claiming the subject matter which is regarded as the invention.

We claim:

1. An evaporable foam pattern for casting a separate water cooled exhaust manifold to be connected to an engine, the assembled pattern being composed of an evaporable foam polymeric material and including inner exhaust conduit means having at least one inlet port to be connected to an exhaust outlet of an engine and having an outlet, said assembled pattern also including outer jacket means spaced outwardly of said exhaust conduit means to provide a cooling passage therebetween, said jacket means having an inlet communicating with said passage and an outlet disposed concentrically outward of the outlet of said exhaust conduit means and communicating with said passage, spacing means disposed in said passage and interconnecting said jacket means and said conduit means, said exhaust conduit means composed of a pair of longitudinally split exhaust pattern sections having abutting longitudinal edges, said jacket means composed of a pair of longitudinally split jacket pattern sections having abutting longitudinal edges, a first of said jacket sections having an aperture mating with and joined to said inlet port, and joining means for joining the abutting edges together.

2. The pattern of claim 1, wherein said spacing means is connected to one of said exhaust conduit means and said jacket means and is provided with an inner extremity abutting the other of said means, and said pattern includes second joining means for joining said extremity to said other means.

3. The pattern of claim 1, wherein said spacing means extends substantially around the entire periphery of said exhaust conduit means and is provided with an interruption at the upper portion of said exhaust conduit means, said interruption defining an opening serving to facilitate sand filling of internal cavities in the pattern in a molding operation and acting to control the flow of water through said water passage in the cast manifold.

4. The pattern of claim 1, wherein said spacing means is disposed adjacent the inlet of said jacket means and comprises a transverse rib extending between said jacket means and said exhaust conduit means, said rib having a discontinuity to provide an opening serving to facilitate sand filling of internal cavities in the pattern in a molding operation and acting to control the flow of water through said water passage in the cast manifold.

5. The pattern of claim 1, wherein said exhaust conduit means has a plurality of inlet ports, said inlet ports disposed in a first of said exhaust pattern sections, said first jacket section having a plurality of said apertures each mating with and joined to an inlet port.

6. The pattern of claim 1, wherein said joining means comprises a layer of adhesive.

7. The pattern of claim 1, wherein said exhaust conduit means has a base portion and said inlet port is disposed in said base portion, said exhaust conduit means also having an upper body portion and the outlet of said exhaust conduit means extending downwardly from said upper body portion.

8. The pattern of claim 7, and including connecting stringer means connecting said body portion and the downwardly extending extremity of said outlet.

9. The pattern of claim 1, wherein said exhaust conduit means includes a body portion containing said inlet and an upper curved elbow portion connected to said body portion, the outlet in said exhaust conduit means being located in said elbow portion and facing downwardly.

10. A pattern for casting a separate metal water-cooled exhaust manifold to be connected to an engine, said pattern being composed of an evaporable foam material and including exhaust conduit means having at least one inlet port to be connected to an exhaust passage of an engine and having an outlet, said exhaust conduit means including a generally upright body portion containing said inlet port and having an elbow portion connected to said body portion and containing said outlet, said elbow portion being generally U-shaped with said outlet facing downwardly, jacket means disposed outwardly of said exhaust conduit means to define a water passage therebetween, said water passage spaced outwardly and concentric to said exhaust conduit means, said jacket means having an inlet communicating with said passage and having an outlet disposed concentrically of the outlet in said exhaust conduit means and communicating with said passage, said exhaust conduit means composed of a pair of longitudinally split exhaust conduit pattern sections having abutting edges, said jacket means being composed of a pair of longitudinally split jacket pattern sections having abutting edges, and joining means for joining said abutting edges, said inlet port facing generally laterally of said body portion and disposed in a first of said exhaust conduit pattern sections, a first of said jacket sections having an aperture mating with and joined to said inlet port.

11. The pattern of claim 10, wherein said exhaust conduit means has a plurality of inlet ports disposed in said first exhaust conduit pattern section, each inlet port being bordered by a first annular surface, said first jacket section having a plurality of said apertures, each aperture being bordered by a second annular surface, said annular surfaces being disposed in abutting relation along a parting line, and connecting means for connecting said abutting annular surfaces together.

12. The pattern of claim 10, and including spacing means disposed within said water passage for spacing said jacket means from said exhaust conduit means.

13. The pattern of claim 10, wherein said body portion is provided with a plurality of spaced transverse holes disposed to receive fastening members to attach the cast manifold to an engine block.

14. The pattern of claim 13, wherein said holes extend through said exhaust conduit pattern sections and through at least one of said jacket pattern sections.

15. The pattern of claim 12, wherein said spacing means extends substantially around the entire periphery of said exhaust conduit means and is provided with an aperture at the upper end of said exhaust conduit means, said aperture serving to facilitate sand filling of internal cavities in the pattern in a molding operation and acting to control the flow of water through said water passage in the cast manifold.

16. The pattern of claim 12, wherein said spacing means is integral with one of said exhaust conduit means and said jacket means and said spacing means has an extremity disposed in bearing engagement with the other of said exhaust conduit means and said jacket means, and adhesive means for joining said extremity to the other of said exhaust conduit means and said jacket means.

17. The pattern of claim 12, wherein said water passage and said spacing means are constructed and arranged to facilitate sand filling of internal cavities of said pattern in a molding process.

18. The pattern of claim 10, and including connecting means for connecting the distal end of said elbow portion with said body portion.

19. The pattern of claim 18, wherein said connecting means comprises a stringer connecting the outlet of said exhaust conduit means with a portion of said exhaust conduit means located adjacent said inlet port.

20. The pattern of claim 19, wherein said stringer is disposed in only one of said exhaust conduit pattern sections.

* * * * *